US010607584B2

(12) United States Patent
Chenoweth

(10) Patent No.: US 10,607,584 B2
(45) Date of Patent: Mar. 31, 2020

(54) INSTRUMENT STAND BAG

(71) Applicant: Scott Chenoweth, Indianapolis, IN (US)

(72) Inventor: Scott Chenoweth, Indianapolis, IN (US)

( * ) Notice: Subject to any disclaimer, the term of this patent is extended or adjusted under 35 U.S.C. 154(b) by 0 days.

(21) Appl. No.: 15/986,216

(22) Filed: May 22, 2018

(65) Prior Publication Data

US 2018/0336869 A1 Nov. 22, 2018

Related U.S. Application Data

(60) Provisional application No. 62/509,329, filed on May 22, 2017.

(51) Int. Cl.
*G10G 7/00* (2006.01)

(52) U.S. Cl.
CPC ..... *G10G 7/005* (2013.01)

(58) Field of Classification Search
CPC ..... G10G 7/005; G10G 5/00; A45C 13/02; B65D 85/54
USPC ..... 206/314; 383/38
See application file for complete search history.

(56) References Cited

U.S. PATENT DOCUMENTS

| | | | | |
|---|---|---|---|---|
| 4,427,113 | A | 1/1984 | Wanner | |
| 5,520,462 | A | 5/1996 | Clark | |
| 6,394,157 | B2 * | 5/2002 | Luna | A45C 3/00 150/104 |
| 6,505,762 | B2 * | 1/2003 | Wilfer | A45F 3/04 206/314 |
| 6,536,156 | B1 * | 3/2003 | Peterson | A01K 97/06 206/315.11 |
| 6,563,036 | B1 * | 5/2003 | Biasini | G10D 13/003 84/327 |
| 6,794,565 | B2 | 9/2004 | Green | |
| 7,365,257 | B2 | 4/2008 | Sato | |
| 8,028,828 | B1 * | 10/2011 | English Darmstadt | A45C 7/0036 206/314 |
| 8,168,873 | B2 | 5/2012 | Okamoto | |
| 8,669,452 | B2 | 3/2014 | Waitzman, III et al. | |
| 2010/0163451 | A1 * | 7/2010 | Stroster | B65D 5/0015 206/575 |
| 2013/0236128 | A1 * | 9/2013 | Bray | B65D 33/12 383/15 |
| 2016/0031634 | A1 * | 2/2016 | Hodges | B65D 5/708 206/213.1 |

OTHER PUBLICATIONS

Amazon, Stagg SPSB SET 5 Professional Gig Bag for Drum and Percussion Hardware, Sep. 1, 2011, 7 pages in total, https://www.amazon.com/Stagg-SPSB-SET-Professional-Percussion/dp/B005LTRCNI/ref=sr_1_7?ie=UTF8&qid=1549249826&sr=8-7&keywords=stagg+bag.

* cited by examiner

*Primary Examiner* — Rafael A Ortiz
(74) *Attorney, Agent, or Firm* — Indiana University Maurer School of Law IP Legal Clinic

(57) ABSTRACT

An instrument bag is movable from an open position facilitating removal of musical instrument components to a closed position storing the musical instrument components in the bag. The bag includes a plurality of compartments that are preferable triangle in shape and a flap that covers openings into the compartments when the flap is closed and provides access to the openings when the flap is in an open position.

16 Claims, 6 Drawing Sheets

INSTRUMENT STAND BAG

CROSS REFERENCE TO RELATED APPLICATIONS

The present application claims the benefit of U.S. Provisional Application 62/509,329, filed May 22, 2017, titled "Instrument Stand Bag" to Scott Chenoweth, the entire disclosure of which is hereby incorporated by reference.

FIELD OF THE DISCLOSURE

The present embodiments relate to a bag for storing drum stands that allow drum musicians to more easily move their stands to and from performances.

BACKGROUND AND SUMMARY OF THE DISCLOSURE

Musicians often use bags to store and transport various musical components, such as drum stands. The components of drum stands often vary in size and shape. Bags used to store and transport these components may include compartments.

Having one bag that is able to conveniently hold more than one stand at a time, but also not be bulky and take up too much room. Also having one type of bag that can carry all the different shapes and sizes of stands would make the musicians lives much easier.

According to the present disclosure, a musical instrument bag is provided including an base layer, and a plurality of storage compartments sized to receive musical instrument components. The plurality of storage compartments are coupled to the base layer. The plurality of storage compartments have a longitudinal axis, a first end, and a second end spaced apart from the first end along the longitudinal axis. The first end has an opening sized and positioned to receive musical instruments components in a direction along the longitudinal axis. The plurality of storage compartments further have a fastener extending substantially parallel to the longitudinal axis, The fasteners is movable from an open position providing access to an interior of the compartments along the longitudinal access and a closed position blocking access to the interior of the compartments transverse to the longitudinal access.

Additional features of the present disclosure will become apparent to those having skill in the art upon consideration of the following detailed description of the illustrative embodiment exemplifying the best mode of carrying out the disclosure as presently perceived.

BRIEF DESCRIPTION OF THE DRAWINGS

The aforementioned aspects and many of the intended features of this invention will grow to be appreciated at a greater level once references to the following accompanying illustrations are expounded upon.

Figure 1:
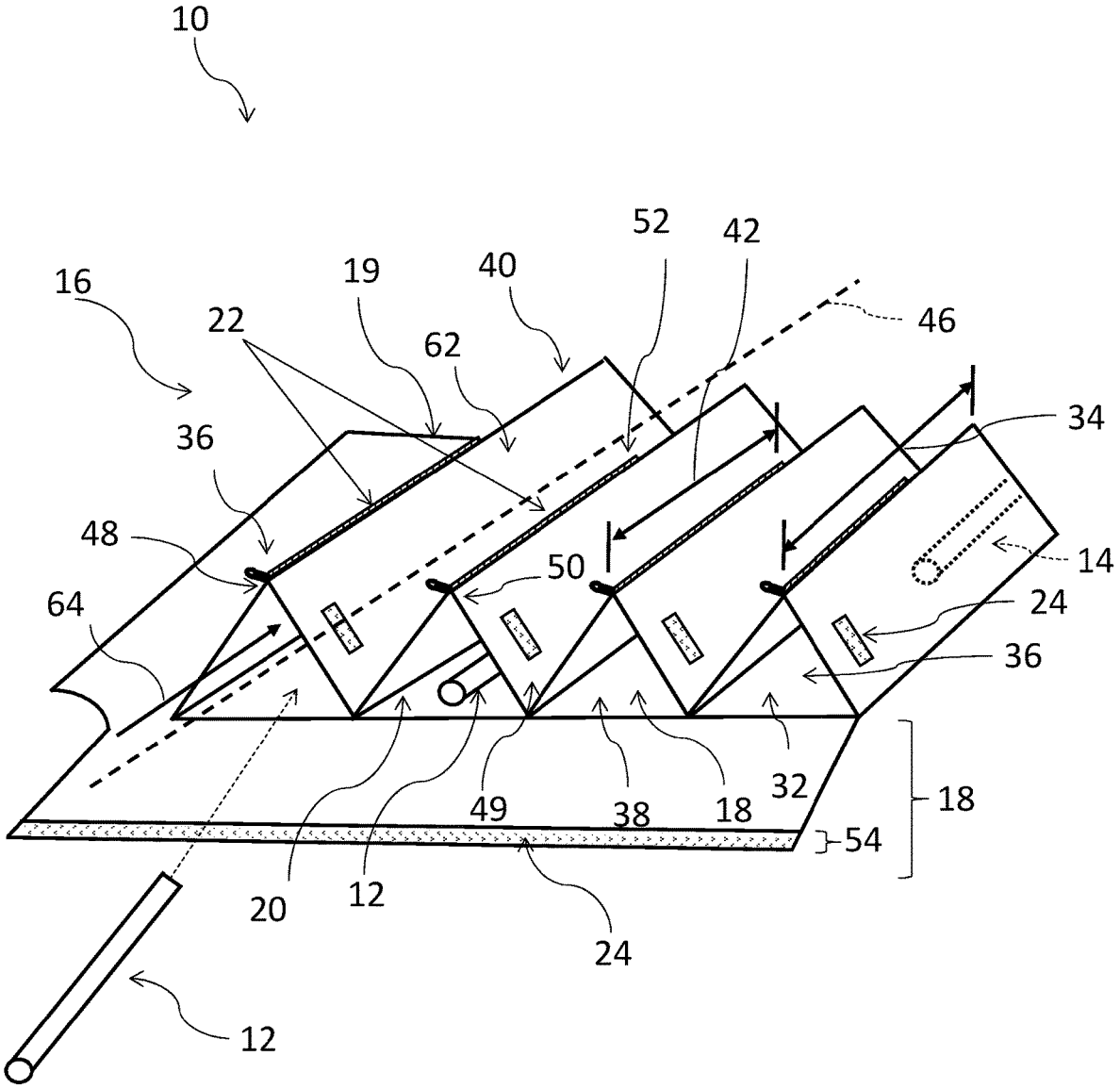
FIG. 1 is a front perspective view of an instrument stand bag in an open position, showing a plurality of triangular compartments in which instrument stand components may be stored and transported.

Equivalent reference components point to corresponding parts throughout the several views. Unless otherwise indicated, the components shown in the drawings are proportional to each other. Wherein, the illustrations depicted are manifestations of the disclosure, and such illustrations shall in no way be interpreted as limiting the scope of the disclosure. For the purposes of promoting and understanding of the principles of the disclosure, reference will now be made to the embodiments illustrated in the drawings, which are described below. The embodiments disclosed below are not intended to be exhaustive or limit the disclosure to the precise form disclosed in the following detailed description. Rather, the embodiments are chosen and described so that others skilled in the art may utilize their teachings. It will be understood that no limitation of the scope of the disclosure is thereby intended. The disclosure includes any alterations and further modifications in the illustrative devices and described methods and further applications of the principles of the disclosure which would normally occur to one skilled in the art to which the disclosure relates.

DETAILED DESCRIPTION OF THE DRAWINGS

According to the present disclosure, a musical instrument stand bag 10 may be used to store and transport components, such as instrument stand components 12, 14. As shown in FIG. 1, bag 10 is in an open position during loading and unloading of instrument stand components 12, 14. After loading, bag 10 may also be in a folded position during storage and transportation as shown in FIG. 2.

Figure 2:
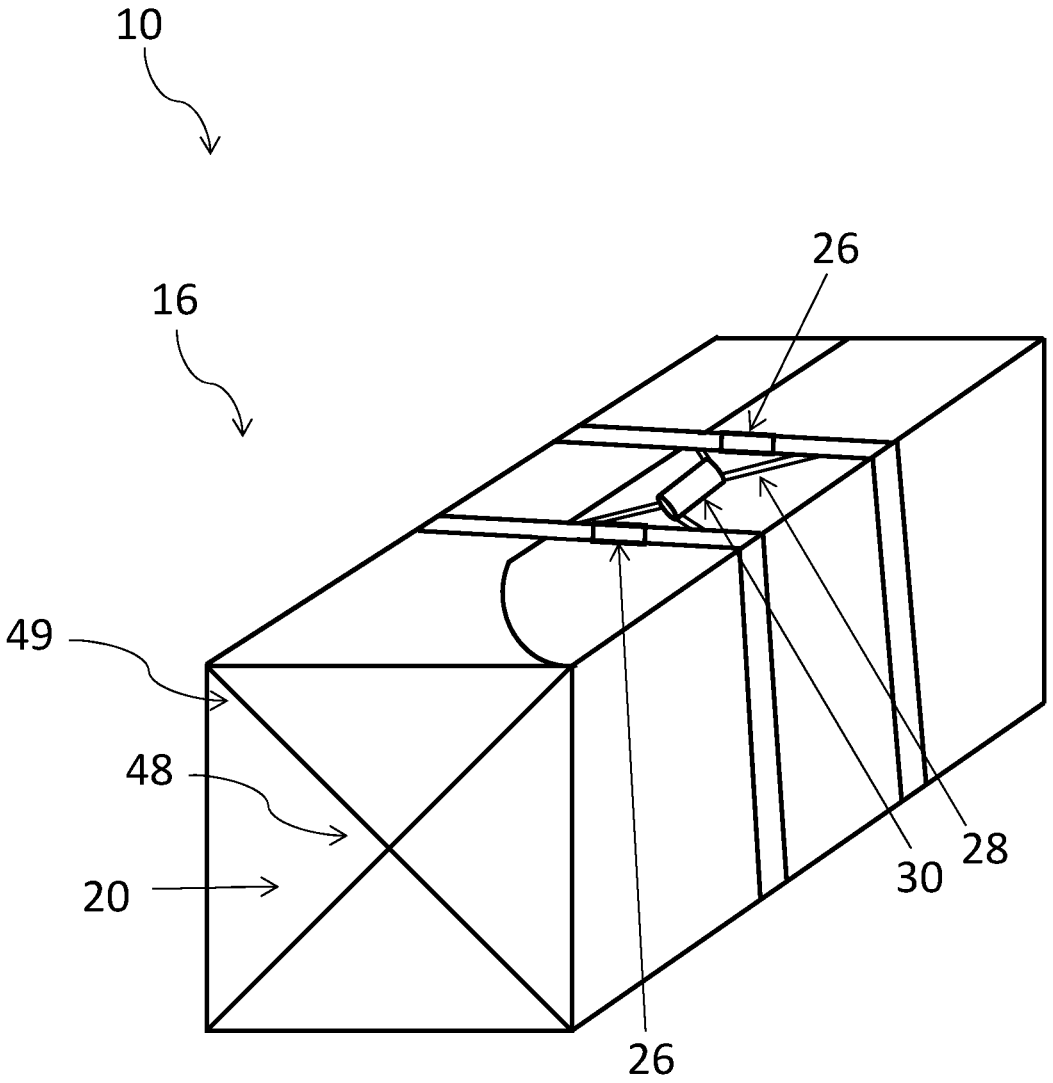
FIG. 2 is a back perspective view of the instrument stand bag of FIG. 1, showing the bag in a folded position.

As shown in FIGS. 1 and 2, instrument stand bag 10 comprises a base layer 16, a front flap 18, a plurality of storage compartments 20, a plurality of fasteners, preferably zippers 22, adhesive material 24, buckles 26, straps 28, and handle 30. Each compartment 20 has an interior 32, a length 34, a first open end 36 with opening 38 and a second closed end 40. In one embodiment, compartments 20 are triangle-shaped.

Zippers 22 of each compartment 20 have a length 42 extending in a direction 44 parallel to a longitudinal axis 46 of compartment 20 at a peak 48 of each compartment 20 that extends about ⅔ of the way along peaks 48 from open ends 36. Each zipper 22 has a first end 50 positioned adjacent to first end 36 and a second end 52 spaced apart from second end 40 by about ⅓ of length 34 of compartments 20. When unzipped in an open position, zippers 22 allow a user to expose most of compartments 20 during loading and unloading of instrument stand components 12, thereby allowing the user to more easily locate instrument stand components 12 that may be stored in compartments 20. When closed, zippers 22 block access to interior 32 of compartments 20 transverse to longitudinal axis 46.

Figure 3:
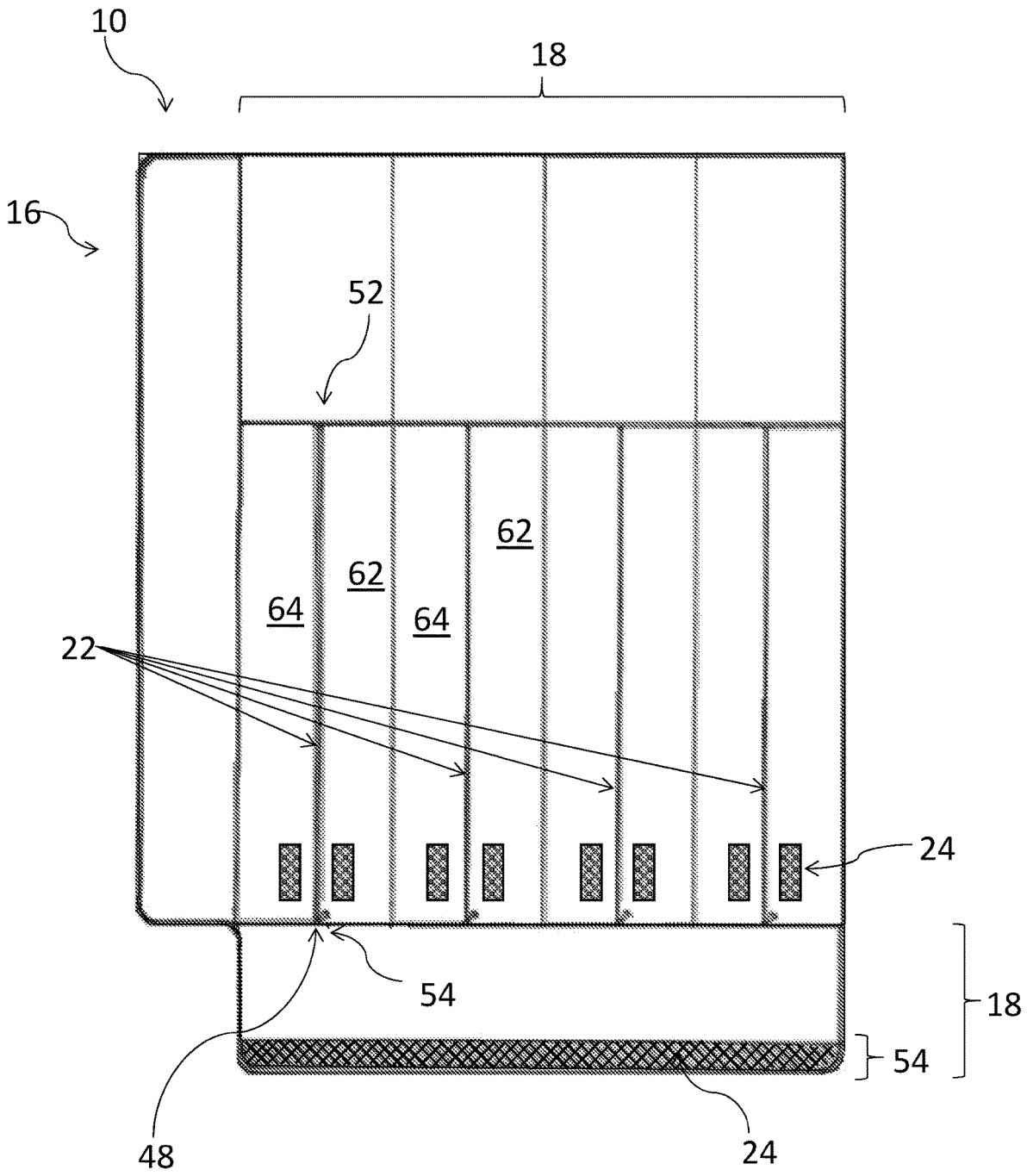
FIG. 3 is a top view of the instrument stand bag of FIG. 1 in an open position.

In one embodiment, adhesive material 24 of bag 10 may be, but is not limited to, hook and loop fasteners, such as VELCRO® brand fasteners. Adhesive material 24 is located at one end 54 of front flap 18 and along external portions of compartments 20. When bag 10 is in an open position, as shown in FIGS. 1 and 3, adhesive material 24 is exposed.

To convert bag 10 and base layer 16 from an open/unfolded position (FIG. 1) to a closed/folded position (FIG. 2), a user first folds front flap 18 from an open position toward compartments 20 such that adhesive material 24 of front flap 18 comes in contact with adhesive material 24 of compartments 20, thereby allowing front flap 18 to move to a closed position to act as a barrier to open ends 36 compartments 20. Flap 18 then covers portions of zippers 22 and defines a plurality of peaks 48 and valleys 49 that match the contour of compartments 20. Another flap 19 (as shown in FIG. 1) extends along the length of at least one of storage compartments 20.

Figure 6:
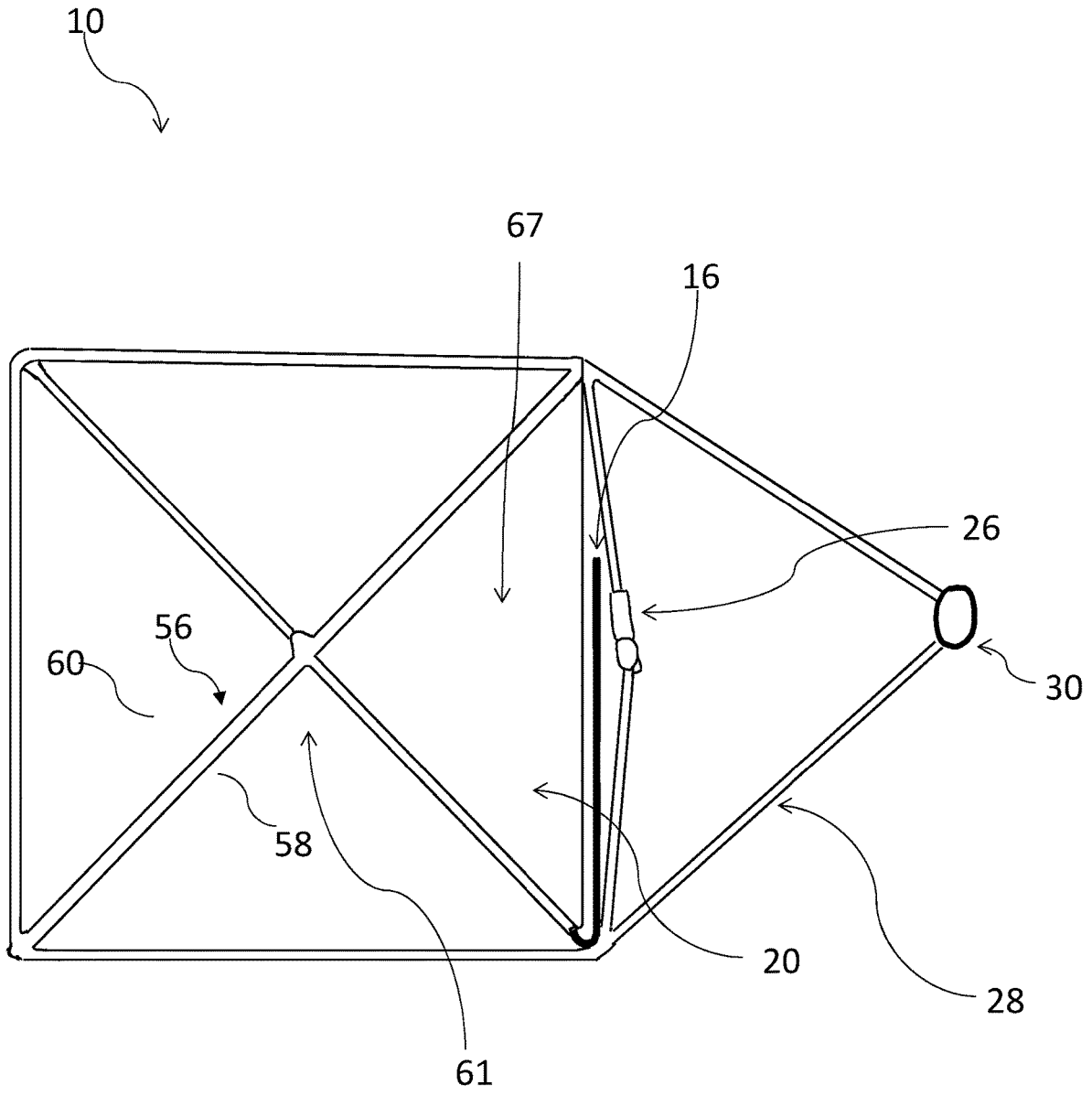
FIG. 6 is a back end view of the instrument stand bag of FIG. 1 in a closed position.

Then, the user folds base 16 such that peaks 48 are positioned adjacent each other and located near the center of the substantial cuboid formed by bag 10 as shown in FIG. 2 so that bag 10 is in a cuboid shape. As base 16 is folded, flap 18 forms folds 56 with two segments/sides 58, 60 each that cooperate to define an X-shape as shown in FIG. 6 with each side 58, 60, positioned adjacent to a side 62, 64 of compartments 20 that define a corner 66. A junction 67 is shown in FIG. 6.

Additionally, buckles 26 may be connected when bag 10 is in a folded position. In this way, bag 10 remains fixed in the folded position and instrument stand components 12 stored in compartments 20 remained secured within compartments 20 when bag 10 is in the folded position. Moreover, the width of bag 10 is reduced in the folded position, allowing bag 10 to occupy a smaller area of space. Straps 28 may be connected to each other by wrapping handle 26 around straps 28. In this way, straps 28 and handle 30 may be used to aid in transportation of bag 10.

Figure 4:
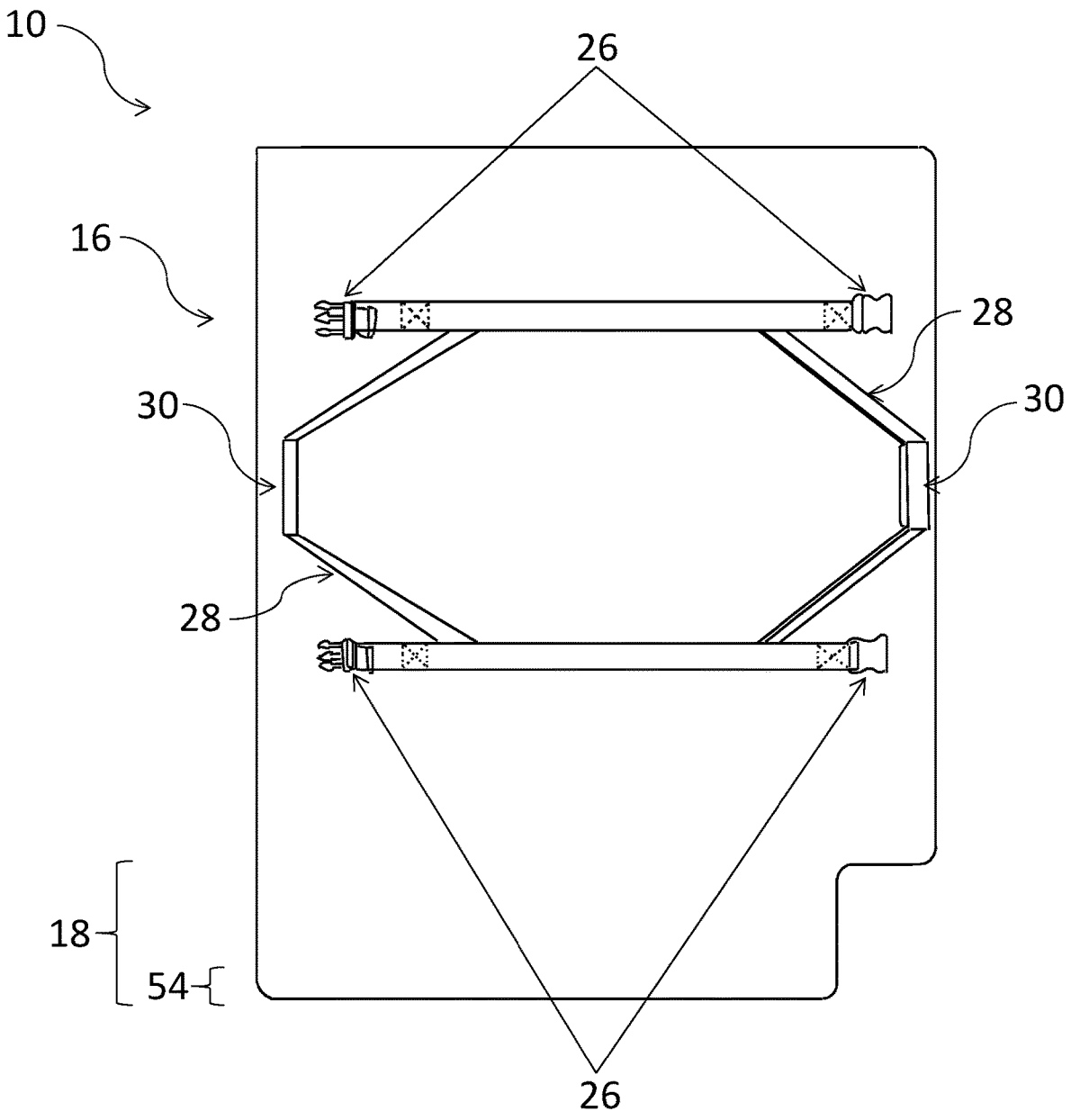
FIG. 4 is a bottom view of the instrument stand bag of FIG. 1 in an open position, showing buckles and straps.
Figure 5:
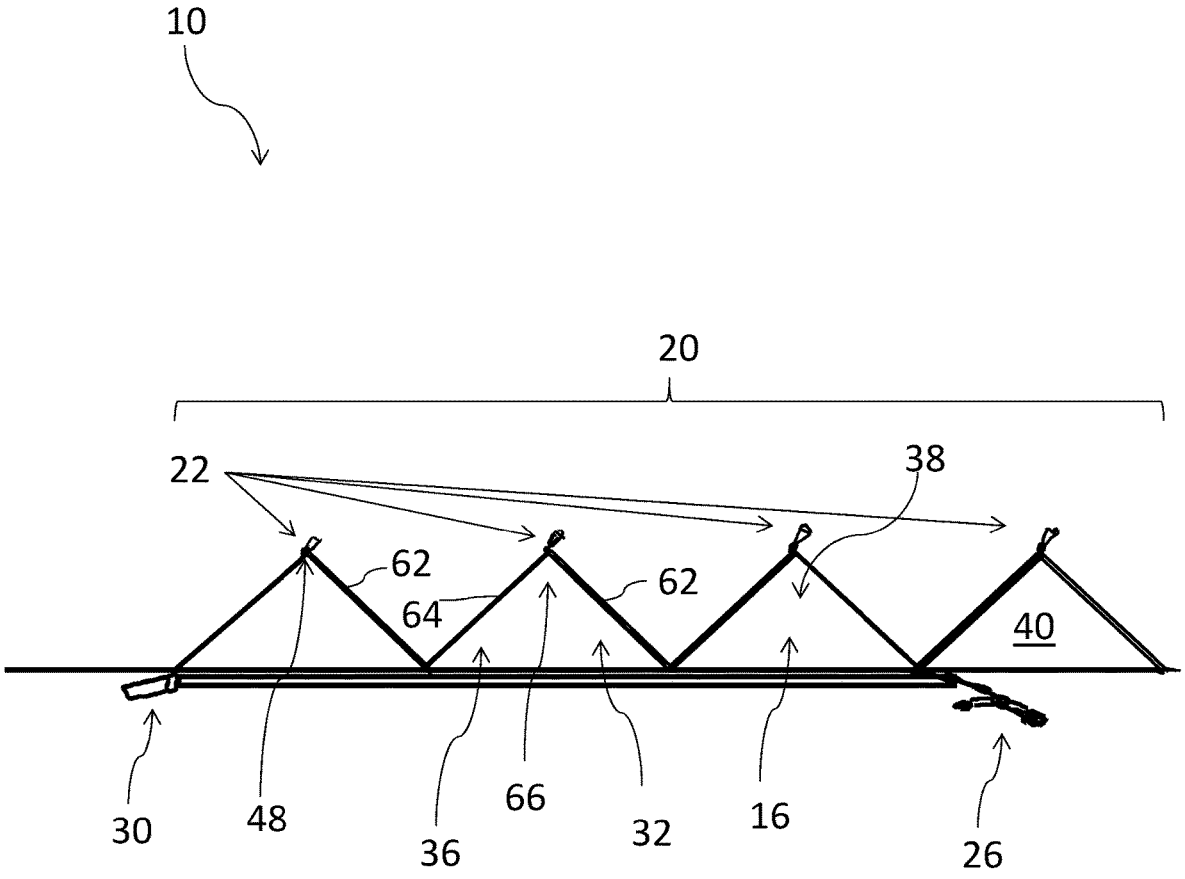
FIG. 5 is a front end view of the instrument stand bag of FIG. 1 in an open position.

FIGS. 3 and 4 shown the layout of base 16 and compartments 20, which are each made of woven nylon. Components, such as compartments 20, are stitched or otherwise fastened to base 16. Base 16 of bag 10 may form an irregular hexagon when bag 10 is in the open position. As shown in FIG. 6, bag 10 may form a substantial cuboid when bag 10 is in the folded position, with buckles 26 and straps 28 extending outward from one side of bag 10. Straps 28 may form a triangular shape with one side of bag 10 when bag 10 is in the folded position. To open bag 10, buckles 26 are unbuckled and bag 10 is laid open pulling peaks 48 away from each other. Front flap 18 is pulled away from compartments 20 exposing open ends 36 and components 12, 14 stored therein.

As mentioned above, compartments 20 are sized to receive instrument stand components 12. Additional details of suitable instrument stand components are provided in U.S. Pat. Nos. 6,794,565, 7,365,257, and 8,168,873, the disclosures of which are expressly incorporated by reference herein. Instrument stand components 12 may be inserted through open ends 36 of compartments 20. Zippers 22 assist in removal of shorter instrument stand components 14 that may find their way toward closed ends 40 of compartments during transportation and therefore more difficult to reach through open end 36. For example, shorter instrument stand components 14 (see FIG. 1) may fall to the back of compartments 20 after insertion such that components 14 are covered by compartments 20. Instead of having to reach into compartments 20 to remove shorter instrument stand components 14, a user unzips zippers 22 to expose components 14, thereby assisting in removal of components 14.

What is claimed is:

1. A musical instrument bag including:

a base layer, a plurality of storage compartments sized to receive musical instrument components, the plurality of storage compartments being coupled to the base layer, the plurality of storage compartments having a longitudinal axis, a first end, and a second end spaced apart from the first end along the longitudinal axis, the first end having an opening sized and positioned to receive the musical instrument components in a direction along the longitudinal axis, the plurality of storage compartments further having a plurality of fasteners extending substantially parallel to the longitudinal axis, the fasteners movable from an open position providing access to an interior of the storage compartments along the longitudinal axis, and to a closed position blocking access to the interior of the storage compartments parallel to the longitudinal axis, and a flap movable from an open configuration providing access to the openings in the first ends of the storage compartments and a closed configuration blocking access to the openings, wherein the flap includes a plurality of segments that cooperate to define an X-shape.

2. The musical instrument bag of claim 1, wherein the plurality of storage compartments have a length extending along the longitudinal axis and the fasteners have a length greater than half the length of the storage compartments.

3. The musical instrument bag of claim 1, wherein each of the plurality of fasteners has a first end positioned adjacent the first end of one of the plurality of storage compartments and a second end spaced apart from the second end of one of the plurality of storage compartments.

4. The musical instrument bag of claim 3, wherein the plurality of storage compartments have a length and the second ends of the fasteners are spaced apart from the seconds ends of the plurality of storage compartments by a distance that is greater than ¼ of the length of the storage compartments.

5. The musical instrument bag of claim 1, wherein the storage compartments are substantially triangular.

6. The musical instrument bag of claim 1, wherein the base layer is movable from a closed configuration to an open configuration, when in the closed configuration, inner most portions of the plurality of storage compartments are positioned adjacent one another, and when in the open configuration, the inner most portions of the plurality of storage compartments are spaced apart from one another.

7. The musical instrument bag in claim 6, wherein the base layer forms a cuboid shape when in the closed configuration and a planar shape when in the opened configuration.

8. The musical instrument bag of claim 1, wherein the storage compartments are triangular having a peak spaced apart from the base layer.

9. The musical instrument bag of claim 8, wherein the fasteners are positioned along the peaks of the storage compartments, the fasteners are connected to the first end of the storage compartments, the access provided by the plurality of fasteners when in the open position is connected to the opening, and the first end of the storage compartments is closed.

10. The musical instrument bag of claim 1, wherein the fasteners are zippers, the plurality of storage compartments are triangle-shaped, the zippers are located at the tops of the triangle-shape spaced apart from the base layer, the access provided by the zippers is connected to the opening of the first end, a distance between two of the zippers is smaller than a distance between the zippers and the base layer when the base layer is in a closed configuration, the musical instrument bag further comprises a flap having a first adhesive material and a plurality of second adhesive materials attached to the storage compartments, wherein the second adhesive materials are configured to be connected to the first adhesive material when the flap blocks the opening of the storage compartments, the first adhesive material is located between at least two of the storage compartments when the base layer is in the second closed configuration, and the base layer forms a cuboid shape when in the second closed configuration and a planar shape when in an second open configuration.

11. The musical instrument bag of claim 1, wherein the flap defines a plurality of peaks and valleys.

12. A musical instrument and bag assembly comprising a musical instrument bag including:

a base layer, a plurality of storage compartments sized to receive musical instrument components, the plurality of storage compartments being coupled to the base layer, the plurality of storage compartments having a longitudinal axis, a first end, and a second end spaced apart from the first end along the longitudinal axis, the first end having an opening sized and positioned to receive the musical instrument components in a direction along the longitudinal axis, the plurality of storage compartments further having a plurality of fasteners extending substantially parallel to the longitudinal axis, the fasteners movable from an open position providing access to an interior of the compartments along the longitudinal axis, and to a closed position blocking access to the interior of the storage compartments parallel to the longitudinal axis, and a plurality of drum stand components positioned in the plurality of storage compartments of the musical instrument bag, wherein the storage compartments are triangular having a peak spaced apart from the base layer.

13. A musical instrument bag including:

a base layer movable from a closed position to an open position, and a plurality of storage compartments having a polygon shape and having an opening sized to receive musical instrument components, the plurality of storage compartments being coupled to the base layer, each storage compartment having a top corner, the plurality of storage compartments being triangle-shaped having the top corners at tops of the plurality of storage compartments, a plurality of hinges defined by the base layer, each located between two of the plurality of storage compartments and extending along a longitudinal axis of the plurality of the storage compartments adjacent to the hinges and pivoting when the base layer moves between the closed position and the open position, when the base layer is in the closed position, a first of the top corners of the plurality of storage compartments is positioned adjacent to at least second and third top corners to define a junction and a maximum distance between the first, second, and third top corners defining the junction is substantially smaller than a distance between the junction and the base layer, and when in the base layer is in the open position, the top corners are spaced apart from each other.

14. The musical instrument bag of claim 1, further comprising another flap extending along a length of at least one of the storage compartments.

15. The musical instrument bag of claim 1, wherein the base layer is movable from a closed configuration with the plurality of fasteners being substantially inaccessible to an open configuration with the plurality of fasteners being substantially accessible.

16. The musical instrument bag of claim 1, wherein the base layer has a length and a width and the longitudinal axis of the plurality of storage compartments are parallel to the length of the base layer.

* * * * *